US008500016B2

(12) United States Patent
Finamore

(10) Patent No.: US 8,500,016 B2
(45) Date of Patent: Aug. 6, 2013

(54) RIFLE SIGHT ANALOG TEMPLATE

(76) Inventor: Brian Finamore, St. James, NY (US)

( * ) Notice: Subject to any disclaimer, the term of this patent is extended or adjusted under 35 U.S.C. 154(b) by 251 days.

(21) Appl. No.: 13/068,925

(22) Filed: May 24, 2011

(65) Prior Publication Data

US 2012/0298751 A1 Nov. 29, 2012

(51) Int. Cl.
*F41G 3/08* (2006.01)

(52) U.S. Cl.
USPC ..... 235/417; 235/404; 235/405; 235/406; 235/418; 434/22; 42/111

(58) Field of Classification Search
USPC ..... 235/404, 405, 406, 417, 418; 434/22; 42/111
See application file for complete search history.

(56) References Cited

U.S. PATENT DOCUMENTS 4,804,325 A 2/1989 Willits
4,923,402 A 5/1990 Marshall
5,194,006 A 3/1993 Zaenglein
5,960,576 A 10/1999 Robinson
6,196,455 B1 * 3/2001 Robinson ..... 235/70 A
7,114,262 B2 10/2006 Andrewes
7,162,825 B2 1/2007 Ugolini

OTHER PUBLICATIONS

Mildot Master Range Guide,Oct. 4, 2010,1 page.
Sniper Flash Cards, Oct. 4, 2010, 14 pages.
Wind S.W.A.G., Oct. 4, 2010, 2 pages.

* cited by examiner

*Primary Examiner* — Daniel Hess
*Assistant Examiner* — Rafferty Kelly
(74) *Attorney, Agent, or Firm* — Alfred M. Walker

(57) ABSTRACT

An analog ballistic system calculator for long range shooting is constructed of a pair of rugged, waterproof rotatable transparent discs superimposed over a base member on one side and a single transparent rotatable disc on the opposite side of the base. The hand held calculator device provides a wind speed and direction and air temperature adjusted calculator device for long distance rifles.

7 Claims, 9 Drawing Sheets

RIFLE SIGHT ANALOG TEMPLATE

FIELD OF THE INVENTION

The present invention relates to an improved analog ballistic system calculator for long range shooting.

BACKGROUND OF THE INVENTION

Various devices are known and available to assist rifle users in accurately hitting a target, such as at a rifle shooting range or in other shooting environments. These known targeting aid devices run the gamut from complex computerized devices to simple traditional flash cards and other visual aids, such as those incorporating a "Mildot" Scale.

One known computer-based targeting aid is disclosed in U.S. Pat. No. 5,194,006 of Zaenglein, which describes a complex type of rifle sighting and aiming device, using a computer.

U.S. Pat. No. 6,196,455 of Robinson discloses a range and drop calculator for use with telescopic gun sights. While the scale on Mr. Robinson's calculator is useful for adjusting the actual line of sight distance, line of sight distancing in practice is not the most accurate. For that matter, the scale is smaller in range.

Also, while simple devices based in the "Mildot" scale may be used for measurement reference when looking at a target through a scope, this simple scale is not broken down fine enough for 10ths of a mil so is not effective in some application. That is, devices using the "Mildot" scale may be OK for short distance calculation that do not need that fine of a breakdown, but at 800 yards+ a target size of 5'10" measures 2.1 vs. 2.25 in mils, which makes a big difference to the accuracy of the answer. At that range, an incorrect distance to target by 5-10% will result in a miss because the bullet is falling more rapidly. In addition, the "Mildot" scale is not spaced out evenly, to accurately let the operator fudge it a little.

Robinson '455 cannot use any other range finding recticle other than "Mildot," so it cannot be used or issued universally as a primary or a backup device. This is because the scale used by Robinson is specialized for only "Mildot." Moreover, the Robinson '455 calculator cannot mix units of measure within a formula, nor add or subtract, multiply or divide, perform windage calculations or target lead calculations. While Robinson '455 can calculate hold off's/Kentucky windage, which is used when there is no time for actual scope adjustments and actually championed by some rather than physical adjustments, the Robinson '455 calculator cannot accurately perform such calculations where the user does not have the exact chart in the his/her possession. Almost all of the information needed for long distance shooting (except how to take several different wind speeds and directions) can be had on various charts because there is no magic. It just becomes a tremendous amount of information for a user to maintain control of, requiring the user to rely upon handheld calculators or PDA's.

Robinson '455 makes many references to ease of use and the fact that having the formula's "built into the scales" (while perhaps limiting usefulness to "Mildot" reticles), which makes Robinson's calculator faster to use. However, ease of use is only useful when it completes the total process needed for the job at hand. If one still needs scrap paper or other calculator devices to perform the total process, the ease of use in Robinson '455 is actually negated because there is a need for several more components to be carried and mastered, even though it might only be a calculator. Picking up one for half of the process, putting it down with the information still visible then picking up another device and transposing the info becomes a lot harder all of a sudden. And of course these additional steps increase the likelihood errors will occur by use of multiple devices simultaneously.

Additionally, when sighting a target with a rifle scope, the elevation adjustment/bullet drop of a projectile is not a perfect curve or semi circle. It is more like a home run in base ball, the projectile starts out fast and straight as it moves away from the gun barrel, but towards the end of the trajectory the forward movement slows considerably as it drops more quickly. Using the Robinson '455 device, the user is only "moving" the point on the curve and then taking an answer. A more accurate way is to find the adjustment at the original distance and then take the cosine of said adjustment, which is called "modified rifleman's rule". The most accurate angle adjustment is called the "slope offset method." But to perform or utilize an accurate adjustment formula requires addition, subtraction, multiplication and division, all of which are not able to be performed on Robinson '455's device.

Furthermore, in a typical example of rifle target sighting, there is a difference of about 0.5 MOA (4") at 800 yards for any particular cartridge. A quality rifle at that range should be able to keep most bullets within an 8 inch circle at that particular distance. This suggested accuracy, however, is without the added consideration of environmental factors, such as wind direction and speed, and air temperature. So, if a sniper is going for a head shot of a simulated insurgent firing on troops, but the simulated target is only showing his head in the window of the target (a head is approx 10×8 inches), the sniper has only 1 inch above the target and 1 inch below (theoretical circle of accuracy) where he aims at the nose of the head of the simulated insurgent portrayed on the target. Add in 4 inches of improper elevation adjustment and the bullet will sail several inches over the head of the simulated insurgent on the window of the target.

OBJECTS OF THE INVENTION

It is therefore an object of the present invention to provide an improved analog ballistic system calculator for long range shooting.

It is also an object of the present invention to provide a wind speed and direction and air temperature adjusted calculator device for long distance rifles.

Other objects will become apparent from the following description of the present invention.

SUMMARY OF THE INVENTION

In keeping with these objects and others which may become apparent, the present invention is an improved analog ballistic system calculator for long range shooting.

Constructed of a pair of rugged, waterproof rotatable transparent discs superimposed over a base member on one side and a single transparent rotatable disc on the opposite side of the base, the hand held calculator device provides wind speed and direction and air temperature adjusted bullet flight calculations, to more accurately use long distance rifles.

The analog ballistic system calculator for long range shooting includes a stationary, flat rule base member having a front face, and a rear face. The front face has an outer, circular scale with target indicia and an inner angle/cosine scale, plus an angle fire protractor within the angle/cosine scale. A rotatable, transparent disc which is mounted on the front face has an outer scale adjacent to the outer, circular scale on said base member. An inner scale is spaced apart from the outer scale adjacent to the inner angle/cosine scale on the base member.

The outer, circular scale on the base member and the outer scale on the rotatable disc provide multiplication and division, whereby target size is located on the outer scale on the rotatable disc aligned with the target indicia on the outer, circular scale on the base member on the front face, which allows computation of distance to target.

On the opposite rear face of the stationary, a flat rule member has a sum scale in an outer ring of numbers, a direction scale ranging from zero to 12 o'clock inner to and spaced from the outer ring of numbers, and a target bloc inner to the direction scale, and annular arrays of inner, blank cosine cells.

Large and small transparent, independently rotatable discs are mounted on the rear face of the base member.

The large disc has an addition and subtraction scale in an outer section thereof adjacent to the sum scale on the rear face, and ½ and ⅓ scales on an inner section, which is spaced from the outer section for quick division useful for windage adjustment equations and interpolation. The small disc is mounted over the large disc and has calculating means thereon to calculate cosine values of wind speed to compensate for wind direction.

This calculator has a means to calculate cosine values of wind speed includes a full value ring surrounding wind speed values, with the small disc overlapping and surrounding the annular arrays of inner, blank cosine cells on the base member, whereby a wind speed value on the small disc is placed over a blank cosine white cell at a wind angle, to provide a reading on the full value ring in a space extending radially outward from the wind speed value of the cosine fraction of the wind speed value, which now avoids the need for use of a separate calculator.

The calculator has an eyelet at a common center of rotation of all rotatable discs and the scales on both faces of the flat base member. Preferably, the base member is substantially rectangular with eyelets in all four corners thereof.

In use, the method of the present invention uses an analog calculator for long range shooting including the following steps of (a) using a stationary, flat rule member comprising:

a front face, and a rear face;

the front face having an outer, circular scale with target indicia and an inner angle/cosine scale and angle fire protractor;

a rotatable, transparent disc mounted on the front face having an outer scale adjacent the outer, circular scale on the member, and an inner scale spaced from the outer scale adjacent the inner angle/cosine scale on the member, the outer, circular scale on the member and the outer scale on the disc providing multiplication and division, whereby target size located on the outer scale on the disc aligned with an indicia on the outer, circular scale on the member face allows computation of distance to target;

the rear face of the stationary, flat rule member having a sum scale in an outer ring of numbers, a direction scale ranging from zero to 12 o'clock inner to and spaced from the outer ring of numbers, a target bloc inner to the direction scale, and annular arrays of inner, blank cosine cells;

large and small transparent, independently rotatable discs mounted on the rear face;

the large disc having an addition and subtraction scale in an outer section thereof adjacent to the sum scale on the rear face, and ½ and ⅓ scales on an inner section spaced from the outer segment for quick division useful for windage adjustment equations and interpolation; and the small disc mounted over the large disc having a full value ring surrounding wind speed values, the small disc overlapping and surrounding the annular arrays of inner, blank cosine white cells on the member;

(b) calculating target range by using the disc on the front face to perform necessary multiplication and division steps.

The method also includes calculating wind drift comprising the steps of:

rotating the small disc to place wind speed value on the small disc over a blank cosine cell at the correct wind direction; and reading the cosine fraction of the wind speed value on the full value ring in a space radially outward from the wind speed to read wind drift for the target under existing wind conditions.

The method further includes the step of providing flat rule member with an eyelet at a common center of rotation of all rotatable discs and the scales on both faces of the flat member, as well as the steps of placing a weighted string through the eyelet, aligning the string with the rifle or a spotting scope, rotating the base member so that the target indicia is lined up with the target, reading elevation angle to target on the angle fire protractor, and using the angle/cosine scale to obtain adjustment for downward or upward elevation to target.

The hand-held manually operated instrument for making rapid mechanical computations is intended for but not limited to use with firearms. The device enables the operator to manually calculate and/or determine all pertinent information needed to accurately engage a long-distance target, including range to target, target size, speed and direction, bullet drop, sight/scope adjustments, various environmental conditions including but not limited to wind speed and direction; and the impact of these calculations on projectiles in flight using either metric, US standard, SI or any combination of these units of measure. The compact design incorporates both classic and custom scales in circular rule form, allowing the operator to manually adjust the various rules in concert with each other, giving the operator rapid and accurate answers to otherwise complicated mathematical equations.

The elevation adjustment/bullet drop of a projectile is not a perfect curve or semi circle. It is more like a home run in base ball, it starts out fast and straight and towards the end, it stops moving forward and drops more quickly. Using the Robinson style/Rifleman's Rule you are only "moving" the point on the curve then taking the answer. A more accurate way is to find the adjustment at the original distance then take the cosine of said adjustment; which is called "modified rifleman's rule". The most accurate angle adjustment is called the "slope offset method" (not sure if it is patented or not, it is just one of those formulas that have been around for a long time) which is in my operations manual. To perform that formula you need addition, subtraction, multiplication and division, all of which are not able to be performed on Robinson '455."

The analog ballistic system depicted on the hand held calculator device is the next evolutionary step in long range shooting aids. It is the culmination of over a century of tried and true mathematical formulas and techniques that have served as the backbone of the long range shooting community. While most formulas and techniques have been around for decades, there has always been "black magic" to the art of long range shooting. To compensate for these traditional inaccuracies, the device of the present invention consolidates, streamlines and systemizes the formulas and techniques of accurately shooting at a target at a long distance range into a logical manually operated format that is not only easy to understand and use, but easy to teach as well.

In contrast to currently used devices, where most if not all calculations that are needed for long range shooting are made with a handheld pocket calculator or PDA device, the device of the present invention is both accurate and easy to use without the need for complicated electronic devices or with other auxiliary devices. While no one disputes the speed of a calculator, the issue lies with the need to accurately and repeatedly press the same little button(s) regardless of the surrounding situation.

The present invention resolves this issue by enlarging the contact surfaces, through the use of ergonomically designed dials and pointers, while keeping the unit comparable in size to current ballistic calculators.

When using other types of exterior ballistic computing devices there may seem to be a disconnect between the information being punched in and the answers that are coming out. If an incorrect, or what seems to be an incorrect answer is displayed, it is very unlikely that one is able to diagnose the problem which then may cause confusion or distrust of the gear; at the very least the whole process must be started over.

The unique analog nature of the device and system of the present invention alleviates confusion by being constructed of several independently manually manipulated parts. Because the operator is rapidly manually calculating the firing solution; if there is doubt in his calculation or is interrupted, he can simply view the previous calculation without entirely starting over. Thus, the operator can diagnose the issue and quickly recognize and remedy the issue, even in a high stress environment.

The ergonomic layout of the transparent rotatable discs on both sides of a base disc, along with a simple systematic approach enables the device and system of the present invention to be used as a training tool. The added benefits of the device and system aid in the initial grasping of concepts dealing with long range shooting. Once these concepts are understood; the device and system of the present invention become an invaluable exterior ballistic computing tool for use in the field.

The reliability and repeatability of the device and system of the present invention was a primary concern when under going development. The device and method is dependent solely on one's ability to manipulate a dial or pointer; there is nothing more reliable than the human finger. In contrast to the present invention, several common shooting aids need a stylus or other small pencil like objects to input data which are difficult to grasp but may also become easily lost rendering prior art units useless.

Unlike other systems which require batteries or need to be carefully handled and maintained, the device and system of the present invention is constructed of temperature and weather stable materials increasing its survivability and durability in the field. Although not recommended, the device and system of the present invention is able to be bent, creased, torn, frozen, left in blazing sunlight, and submerged for prolonged periods of time while still being usable and effective.

The device and system of the present invention consolidates and systemizes the necessary steps to achieve a high percentage first shot hit capability into a robust yet simple ergonomically designed package. Not only does this improve initial orientation and simplify training, but it offers a simple, better, cost effective alternative to other more expensive, less durable long distance shooting aids.

In general the device and system of the present invention employs a combination of elements of a "round slide rule" plus a "protractor" for use in rifle ballistics and aiming. The scale on the device and system of the present invention is able to be used for taking the cosine for any numerical value not only for line of sight distance (angle of target movement etc. which is impossible to do on prior art, such as Robinson '455.

The reason for the circular layout of the device and system of the present invention is that the designated C and D scales can multiply and divide, other scales add and subtract. In order to not "run out" of numbers a circle is used, one only has to mentally move the decimal one position.

The device and system of the present invention is able to be used with a variety of other range finding reticles out on the market at this time.

In use, when aiming up or down a hill at a target, a side orientation is employed. For example, the hold "top" of the device is parallel to the angle that the rifle is being held at; other smaller single purpose angle devices are actually attached to the rifle or scope to ensure the angle is correct.

The device and method of the present invention is advantageous in that it is a tool that enables systematic and repeatable windage measurements along with the ability to calculate using any and all types of units of measure. It also enables distance to target to be accurately calculated using any and all types of units of measure. It is also a tool that enables target lead to be accurately calculated, as well as target speed to be calculated.

The device and method enables the user to calculate Wind Drift, Wind Speed and Wind Direction, and the operator is able to take at least three different readings at different ranges . . . . In contrast, all other ballistic computing devices analog, digital or desktop based have only one or two windage inputs.

The device and method of the present invention improves the user's probability of a "first hit" of a long distance target. Most other training and even in competitions there are "sighters", giving the rifleman a few shots to figure out the conditions. Although fine for recreational target competition, while hunting or in military action a first round hit is desired. Once the first shot is fired and point of impact is seen (which is hard to do most of the time, even in good weather and bright light) one only has to compare the point of aim to the point of impact, wait for the same environmental/wind conditions as when the first shot was fired, hold off or adjust sights to compensate i.e. 10 inches up and 5 inches to the left, then the user fires, and more than likely achieves a first hit.

The device and method of the present invention is also useful for subsequent shots after the first shot for either aiding in determining the measurement and adjustment needed plus, more often than not, there may be a timed event; if it is for a sniper, the user may not want to hang around that long for the same conditions to occur again after the user's locational position has been compromised. If the miss is off enough there might even be a totally new measurement of the target and conditions to ensure the correct numbers and distance adjustments are used.

On the back side of the device, there is noted the designation "Inner White Cell" and "full value ring". The inner white cells are a percentage/cosine of the full value ring/100%. Placing a number in the inner white cell and then following it outward to the full value ring essentially take the inner white cell number and multiplies it by the cosine of the angle from which the wind is coming from, without using a calculator or computerized PDA device.

For example, a wind coming from 1:30 in relation to the firing position/target is at a cosine of 0.707 (70.7% of the wind speed is acting on the left right movement of the bullet in flight). If measured wind speed is 15 MPH one needs to multiply by 0.707 in order to calculate the adjustment needed. If the user were to use a calculator instead of the device of the present invention, the answer can surely be had, but under outdoor weather conditions the user would have to push "1, 5, x, . . . , 7, 0, 7,=" under pressure and with gloves etc. then do the same process 2 more times (three wind reading total), then add, subtract or divide, dictated by the formula and wind directions needed for that particular application, all of which can be avoided by using the device and method of the present invention.

The designated cells on the device do the cosine application and then one can use the outer most rings of numbers (addition and subtraction scales) to finish the process. All that is needed is the spinning of discs, one does not even have to understand the numbers or the math just be told "put this there—spin, put this there—spin, take that number and put it on the user's rifle and shoot". That in essence is what really makes the device and method of the present useful and quick. When rotating the discs to perform computations the actual numbers are irrelevant, only the final one is needed for the shot. Until then the user can say to one's self "2 lines to the left of 1.5, place under 3.2, look at the answer and that is you answer"; there is no need to know if the user is dividing one time and multiplying the next. The user just needs to perform the spins of the rotatable transparent discs over the base disc.

The opaque (half moon) has 4 different scales. The outer scale is considered FULL VALUE or 100% effect. The next inner scale is 86%, next inner is 70.7% and the innermost is 50%. All in relation to the outermost. When observing the outermost and following it to the #25; the following it down to the innermost and one will see #50, showing that 50 on the innermost/50% is equal to 25 on the FULL VALUE 100% scale. In order to use the formula one must use FULL VALUE #s in the equation.

Each of those 4 scales is used with the clock system of determining wind direction, which in turn determines the percentage of wind effect, which then has to be converted in to FULL VALUE to be used in the formulas.

Example

Wind direction and value/effect:
50% (Half Value): 1:00, 5:00, 7:00, 11:00
70%: 1:30, 4:30, 7:30, 10:30
86%: 2:00, 4:00, 8:00, 10:00
100% (Full Value): 3:00, 6:00
0% (no effect on horizontal impact) 12:00, 6:00
Place the opaque over the transparent disc, locate #50 on the innermost scale. Place #50 on the centerline of the innermost box below 1:00. Without moving the discs follow #50 to the box under 1:00, you will notice #25 is on the center line. Doing that has just converted a 50 mph wind value at 1:00 (50%) to 25 mph (full value) which is then used in the formula.
One looks at the conditions chooses the time on the clock/wind direction.
Approximates the wind speed.
Locates the "inside" box corresponding to the time on the clock.
Rotate the opaque until numbers/wind speed appear in the inside box.
Follow outward to the outside box.
Conversion to FULL VALUE has been completed.
Having these inside boxes limits the possibility of the operator choosing the wrong percentage scale for that particular wind direction; choosing the 86% scale when the wind direction calls for the 50% scale. If one chooses the 86% scale for the 1:00 wind direction the numbers on that scale will not fall into to a "box". By choosing the wrong scale the operator will be incorrectly converting the wind speed which will cause an incorrect FULL VALUE conversion leading to incorrect adjustments being calculated.

In the example there is a difference of about 0.5 MOA (4") at 800 yards for that particular cartridge.

A quality rifle at that range should be able to keep most bullets within an 8" circle at that particular distance; then add environmental factors. So, if a sniper is going for a head shot of an insurgent firing on troops but is only showing his head in the window (head is approx 10×8") he will only have 1" above and 1" below that theoretical circle of accuracy if he aims at the nose. Add in 4" of improper elevation adjustment and the bullet will sail a few inches over his head.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
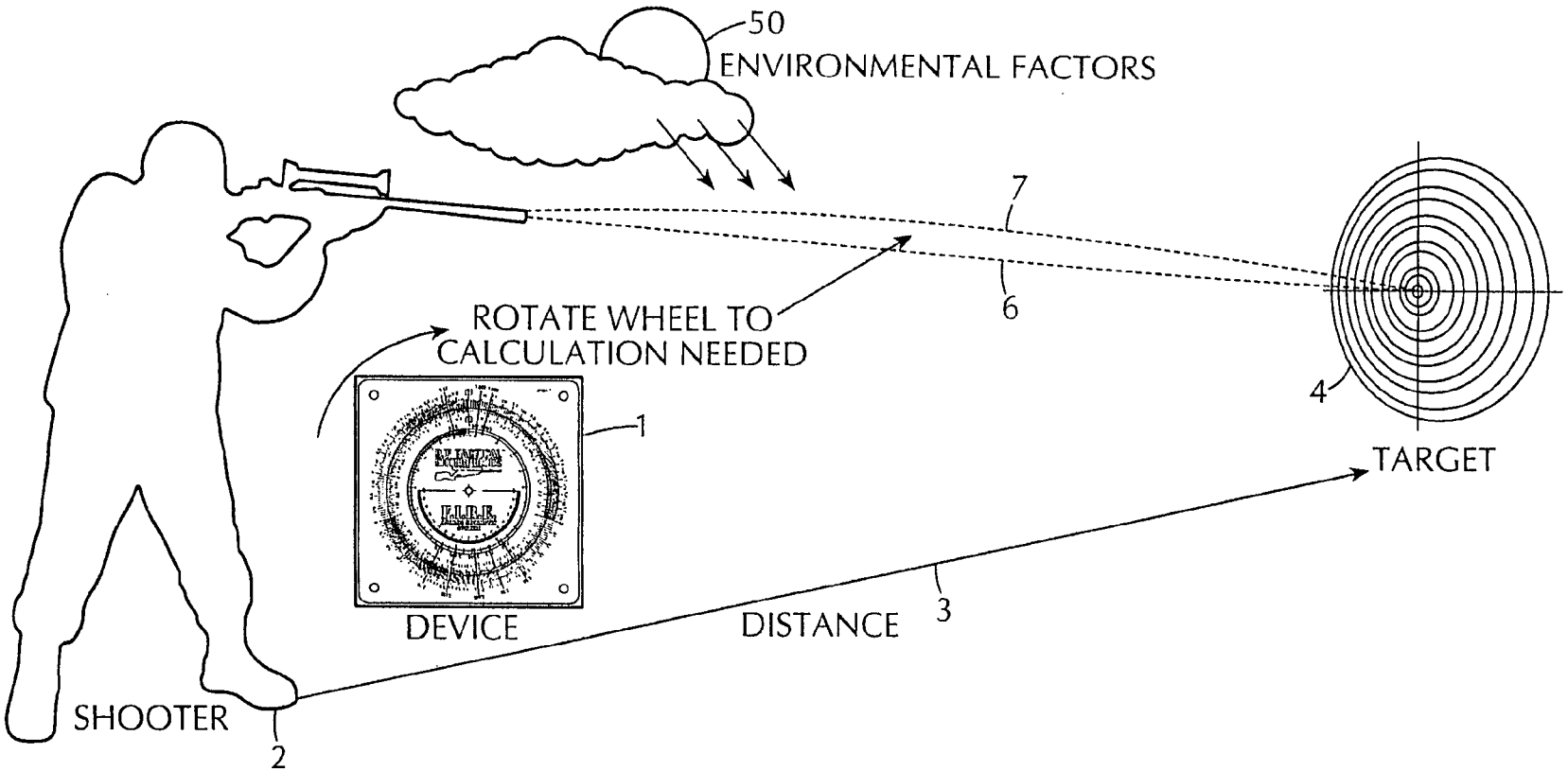
FIG. 1 is a schematic representation of the use of the analog ballistic system calculator of this invention to compensate for environmental factors to achieve accuracy.

The present invention has broad applications to many technical fields for a variety of articles. For illustrative purposes only, a preferred mode for carrying out the invention is described herein The analog ballistic system calculator of this invention is intended to enable a long range shooter to vastly improve his probability of a first-shot hit by compensating for a number of environmental factors that affect accuracy. FIG. 1 illustrates how the calculator 1 is used to adjust the aiming line-of-sight 6 to affect the actual bullet trajectory 7 to hit a target 4. Shooter 2 uses calculator 1 to help determine the distance 3 to the target 4, which takes into account environmental factors 50 such as wind speed and direction. Effects of angle of fire, temperature, and humidity also are compensated for by the calculator 1 to solve relevant formulas.

Calculator 1 is a flat device with an opaque square base 5 with two annotated faces 10 and 15 as well as three transparent annotated disks 11, 17, 19, having the same axial center and which rotate about an axial center of the base, and with respect to each other to adjust circular numeric scales in registration with other scales or markings.

Figure 2:
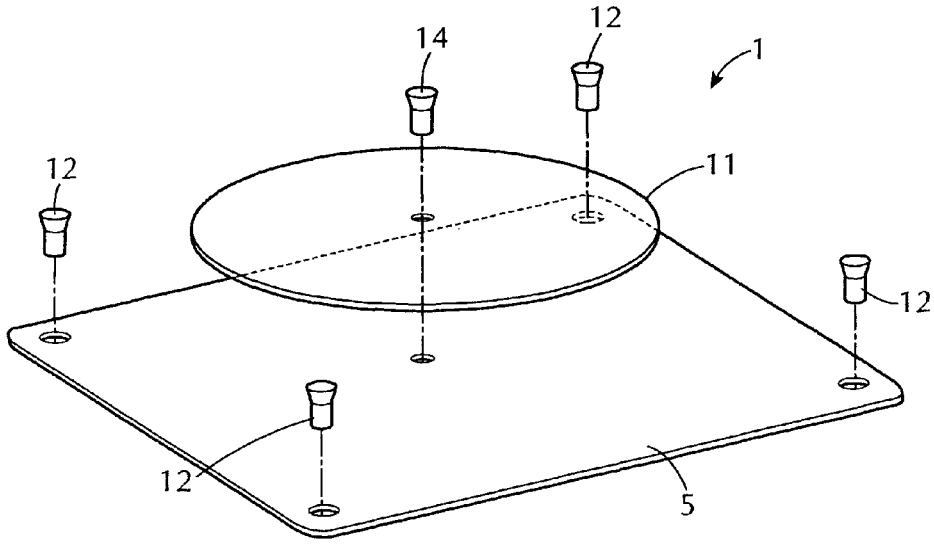
FIG. 2 is a perspective exploded view of the first face of the calculator of this invention showing a transparent disk atop a square base.

FIG. 2 is a schematic exploded view of the front face of calculator 1 of this invention. The square base 5 consists of two face layers, front face 10 (FIG. 2) and rear face 15 (FIG. 3), which face layers are attached to either side of base 5 via four corner grommets 12, or other attaching means, without limitation. In FIG. 1, front base face 10 is shown with transparent annotated disc 11 (scale not shown in FIG. 1) pivoted on central pin or grommet 14 positioned at the axial center, enabling disc 11 to be able to rotate atop face 10.

Figure 3:
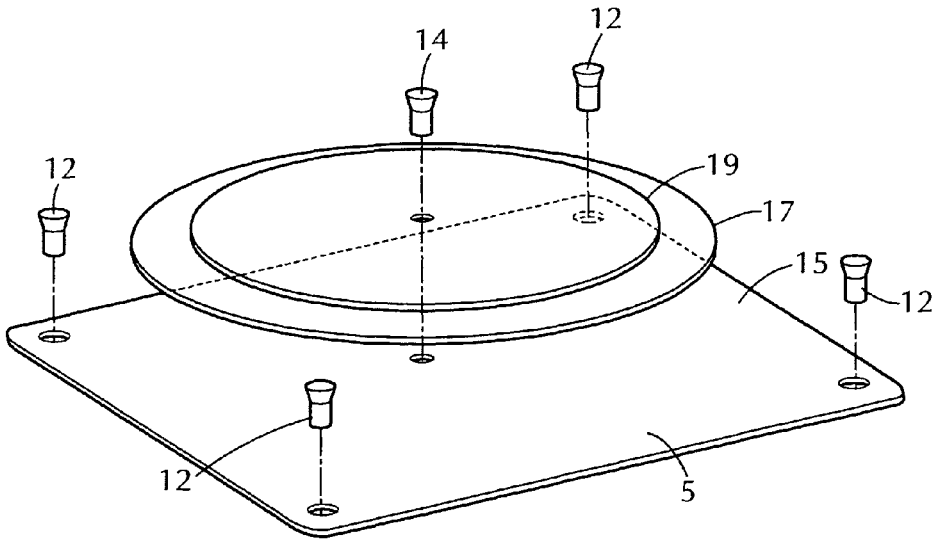
FIG. 3 is a perspective exploded view of the rear face of the ballistic calculator showing a small transparent disk atop a larger transparent disk atop a square base.

FIG. 3 is a schematic exploded view of the rear face of the square base 5 of calculator 1. Rear face 15 is positioned on base 5 on the opposing surface to that upon which transparent annotated disc 11 is rotatably attached. Rear face 15 is shown with two transparent disks rotationally attached via a pin or central grommet 14 positioned at the axial center, enabling discs 17 and 19 to rotate thereon. Disk 17 is the larger of the two disks, located next to base face 15, while the smaller disk 19 is positioned atop disk 17.

Figure 4:
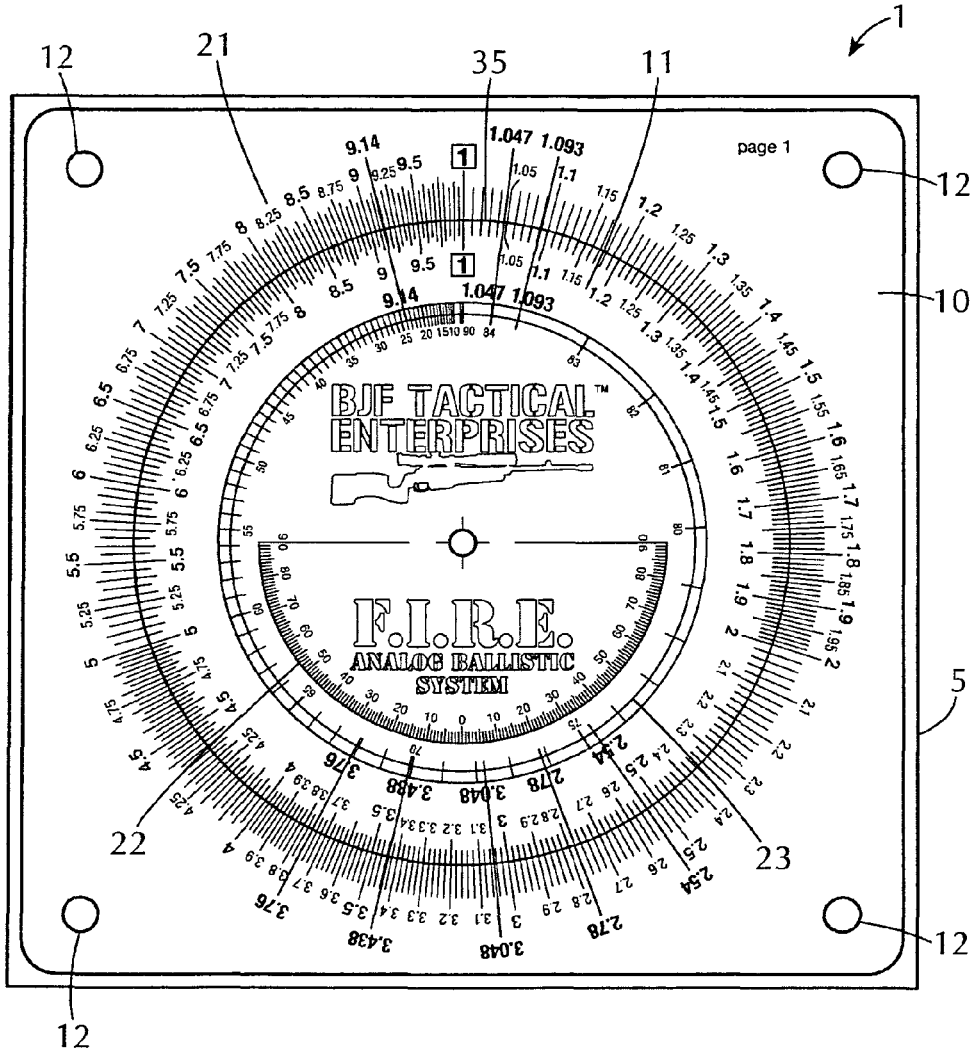
FIG. 4 is a plan view of the assembled front face of the ballistic calculator.

FIG. 4 shows the front face 10 of the assembled calculator 1.

Figure 6:
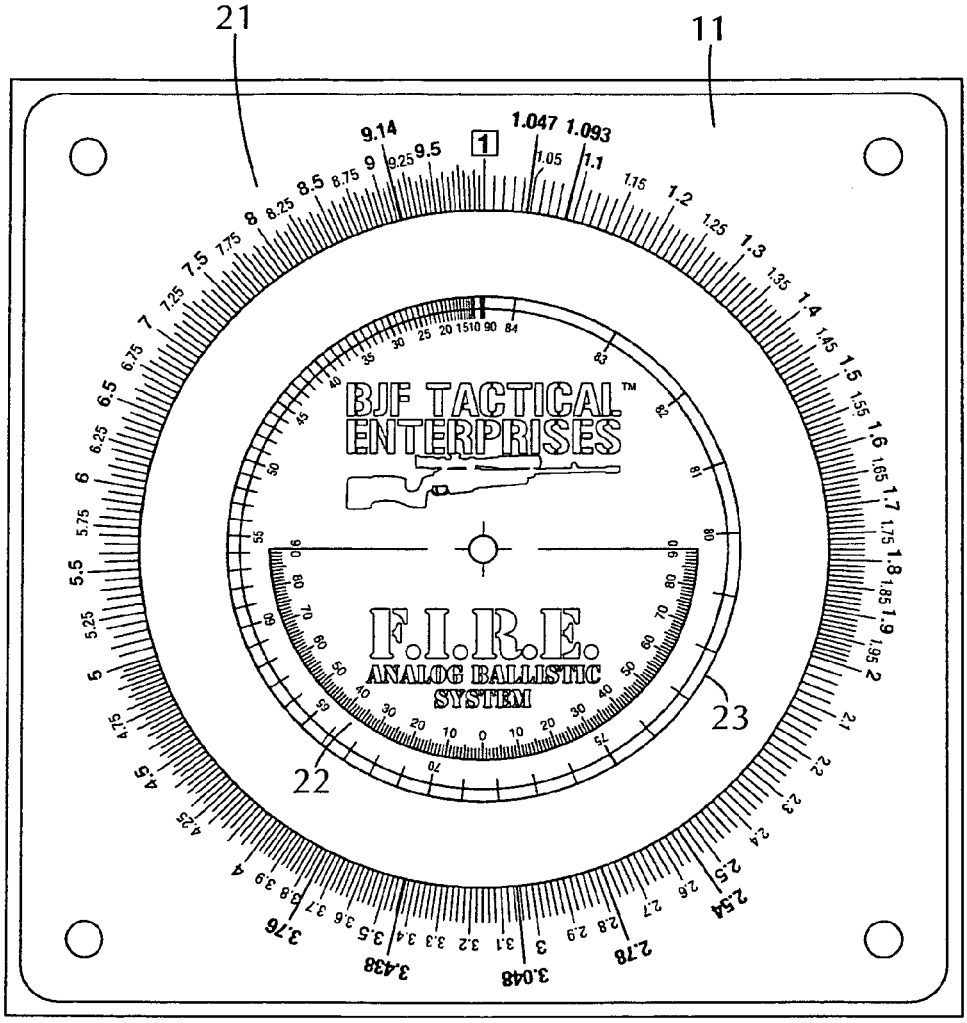
FIG. 6 is a plan view of the base front face with annotations.
Figure 7:
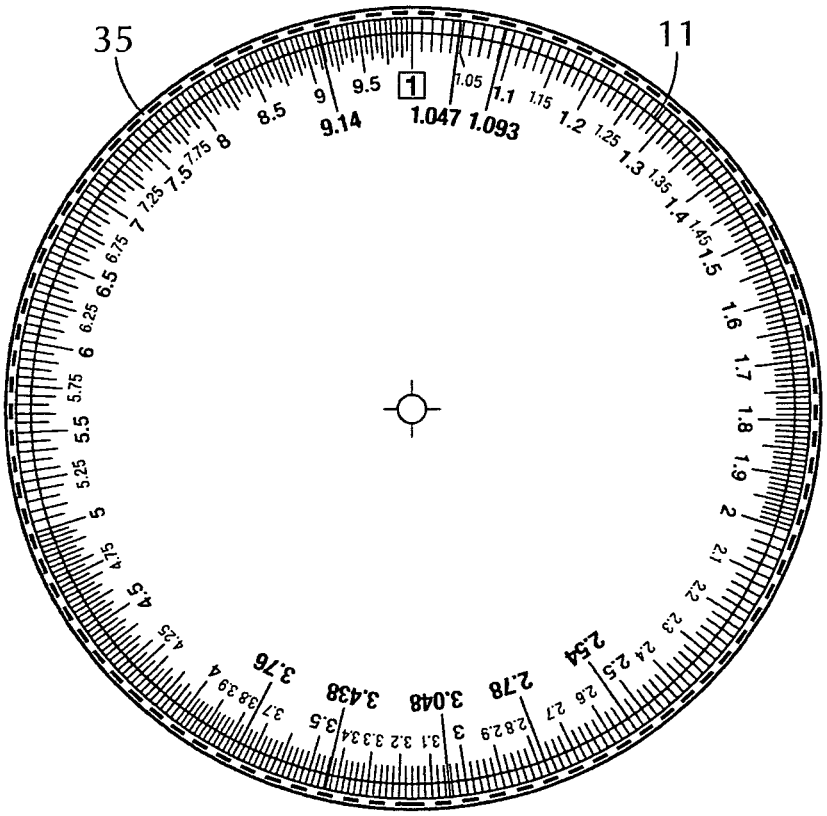
FIG. 7 is a plan view of the transparent disk with annotations which is pivoted atop the base face shown in FIG. 6.

FIG. 6 shows the annotations on the opaque base front face 10, while FIG. 7 shows the annotations of the transparent disk 11. Angle fire protractor 22 is used with a weighted string attached to center grommet 14. The angle is read on scale 22 and noted on scale 23, Then, the string or a straight edge is used from center grommet 14 to the angle on scale 23 and onward to the intersection with "C" scale 21. This defines the cosine of the angle in question, which is then read. Inner scale 35 on disk 11 is the "D" scale as on a standard slide rule. Multiplications and divisions are performed using the C and D scales.

Figure 5:
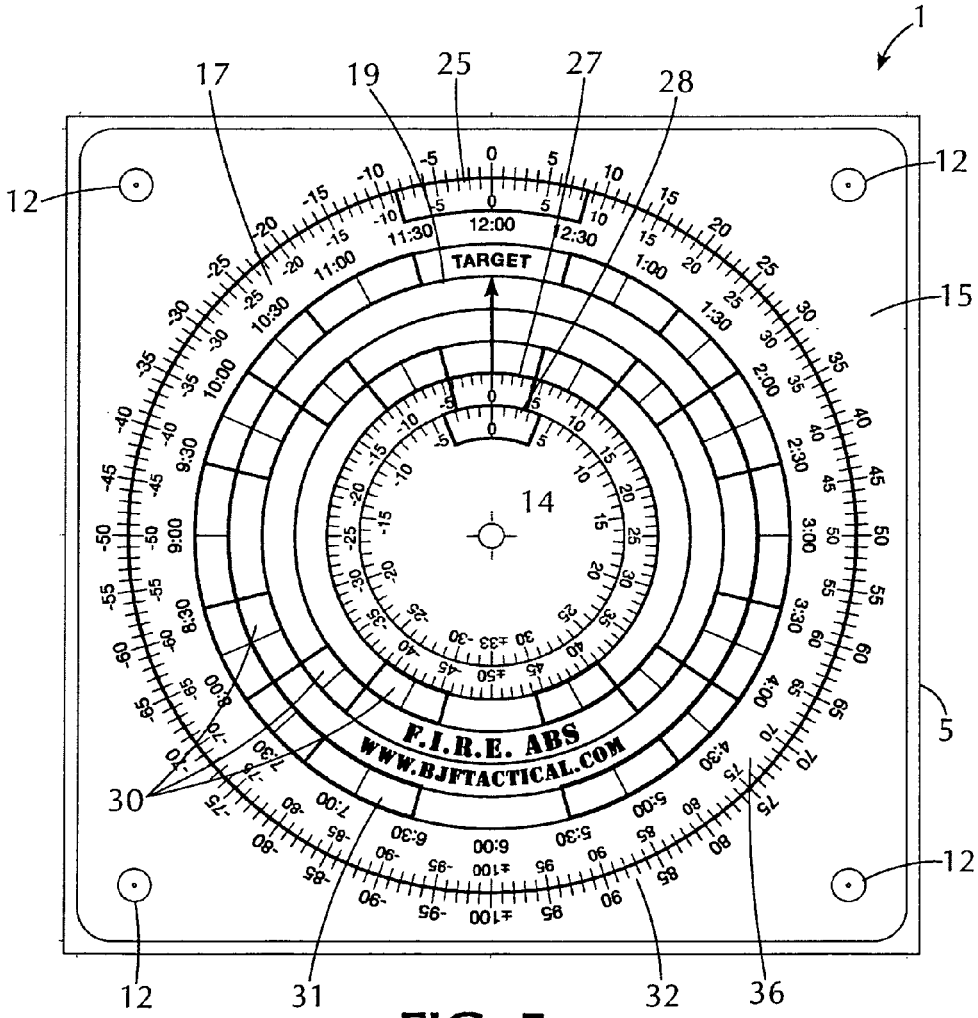
FIG. 5 is a plan view of the assembled rear face of the ballistic calculator.

FIG. 5 shows the rear face of assembled calculator 1.

Figure 8:
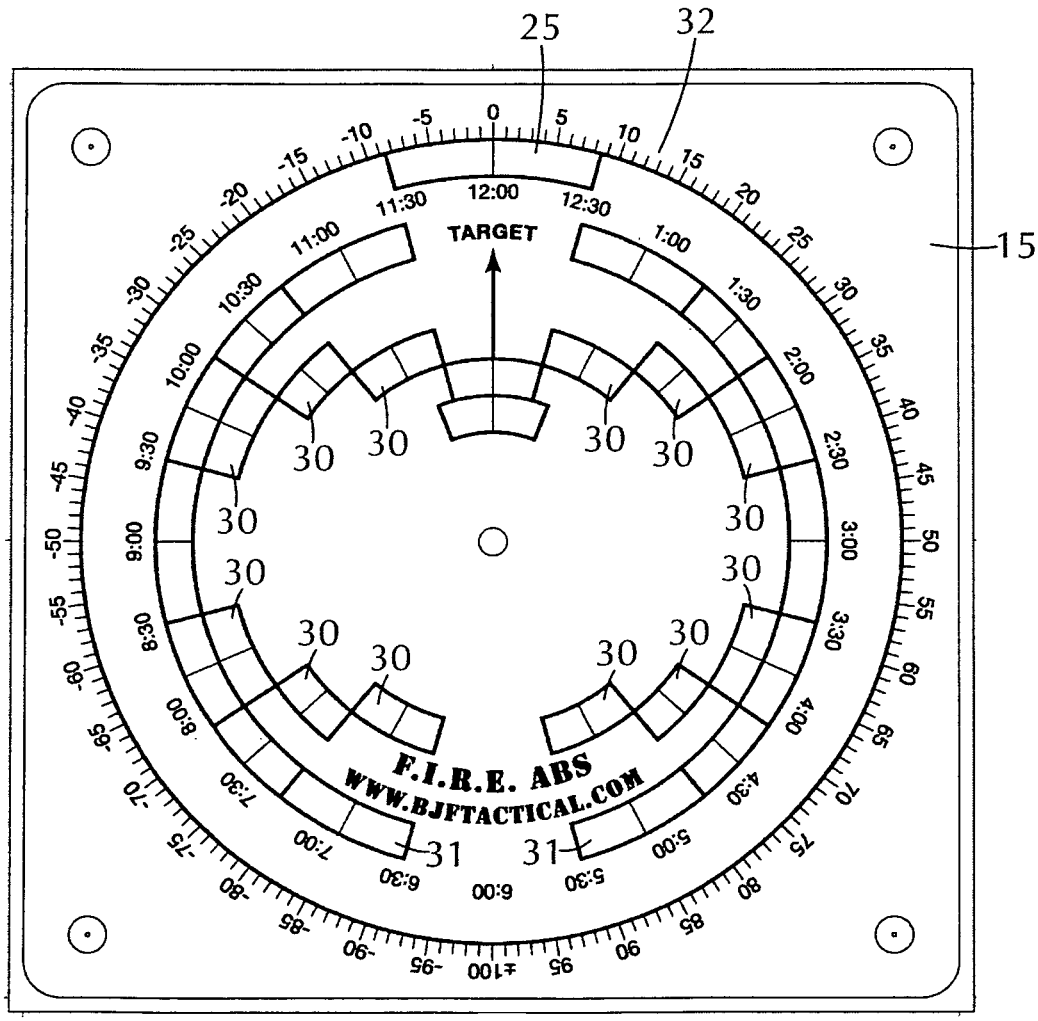
FIG. 8 is a plan view of the base rear face with annotations.
Figure 9:
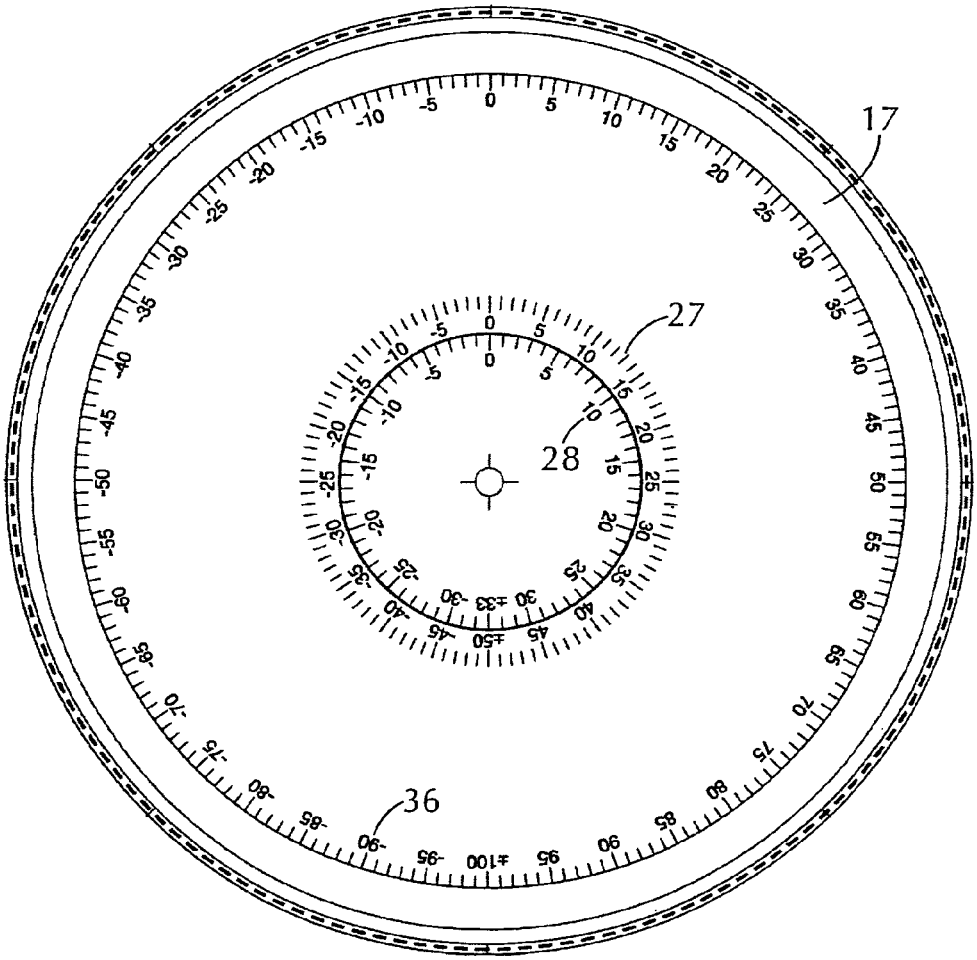
FIG. 9 is a plan view of the large transparent disk which is pivoted atop the rear base face of FIG. 8.
Figure 10:
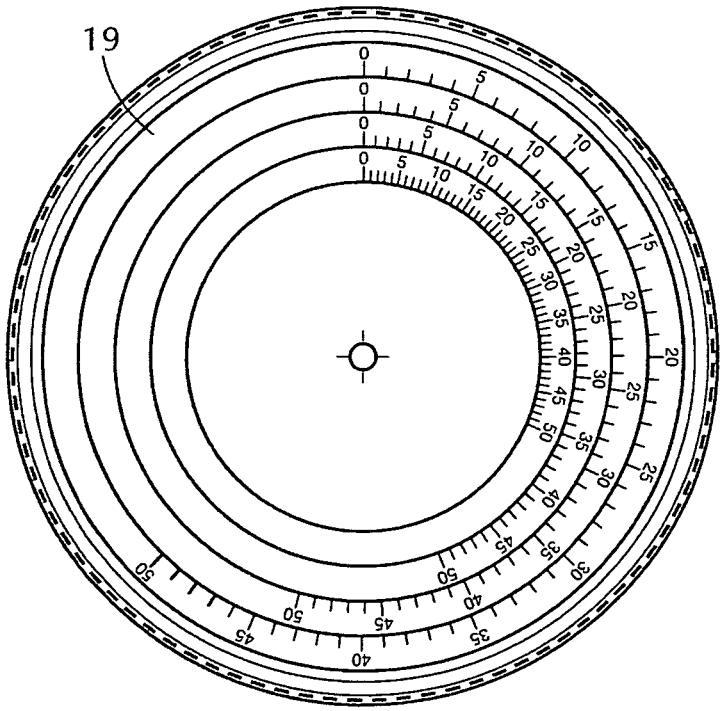
FIG. 10 is a plan view of the smaller transparent disk pivoted atop the larger transparent disk of FIG. 9.

FIG. 8 shows the annotations on the opaque base rear face 15. FIGS. 9 and 10 show the annotations of transparent disks 17 and 19, respectively. Addition and subtraction operations are performed on base scale 32 and rotatable inner scale 36 on disk 17. Region 25 is used with these scales. In addition, half scale 27 and ⅓ scale 28 on disk 17 are used for those calculations.

The repeated white cell regions 30 along with white full value ring 31 on rear base face 15 are in radial registration with the four scales on disk 19. These are used to calculate the effects of wind velocity and direction.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. An analog ballistic system calculator for long range shooting comprising:

a stationary, flat, rectangular rule member having an axial center, a front face, and a rear face;

said front face having an outer, circular face scale with a target indicia and an inner angle/cosine scale, and an angle fire protractor within said angle/cosine scale;

a rotatable, transparent disc mounted on said front face having an outer front disc scale adjacent said outer, circular face scale and an inner front disc scale spaced from said outer front disc scale adjacent said inner angle/cosine scale, wherein said outer, circular face scale and said outer front disc scale configured for multiplication and division and computing distance to a target by aligning a target size located on said outer front disc scale with said target indicia on said outer, circular face scale;

said rear face having a rear face sum scale in an outer ring of numbers, a rear face direction scale ranging from zero to 12 o'clock inner to and spaced from said outer ring of numbers, a rear face target bloc inner to said direction scale, and rear face annular arrays of inner, blank cosine cells;

large and small transparent discs, independently and rotatably mounted on said rear face;

wherein said large disc having an addition and subtraction scale in a disc outer section thereof adjacent to said rear face sum scale, and ½ and ⅓ scales on a disc inner section spaced from said disc outer section configured for quick division needed for windage adjustment equations and interpolation; and wherein said small disc is rotatably mounted over said large disc and having means to calculate cosine values of wind speed to compensate for wind direction.

2. The calculator of claim 1 in which said means to calculate cosine values of wind speed comprises a full value ring surrounding wind speed values, said small disc overlapping and surrounding said annular arrays of inner, blank cosine cells comprising said front face whereby a wind speed value on said small disc positioned over a blank cosine white cell provides a corresponding reading on said full value ring in a space radially outward from said wind speed value of the cosine fraction of said wind speed value, thereby avoiding the use of a separate calculator.

3. The calculator of claim 2 having an eyelet at a common center of rotation of all rotatable discs and the scales on both faces of said flat, rectangular rule member, which passes through the axial center.

4. The calculator of claim 3 in which said flat, rectangular rule member comprises eyelets in all four corners thereof.

5. A method of using an analog calculator for long range shooting, comprising the steps of:

(a) using a stationary, flat, rectangular rule member comprising:

an axial center, a front face, and a rear face;

said front face having an outer, circular face scale with a target indicia and an inner angle/cosine scale and angle fire protractor;

a rotatable, transparent disc mounted on said front face having an outer front disc scale adjacent said outer, circular face scale, and an inner front disc scale spaced from said outer front disk scale adjacent said inner angle/cosine scale, wherein said outer, circular face scale and said outer front disc scale are configured for multiplication and division and computing distance to a target, by aligning a target size located on said outer front disc scale with said target indicia located on said outer, circular face scale;

said rear face having a rear face sum scale in an outer ring of numbers, a rear face direction scale ranging from zero to 12 o'clock inner and spaced from said outer ring of numbers, a rear face target bloc inner to said direction scale, and rear face annular arrays of inner, blank cosine cells;

large and small transparent discs, independently and rotatably mounted on said rear face;

wherein said large disc having an addition and subtraction scale in a disc outer section thereof adjacent to said rear face sum scale, and ½ and ⅓ scales on a disc inner section spaced from said disc outer section configured for quick division needed for windage adjustment equations and interpolation; and wherein said small disc is rotatably mounted over said large disc and comprises a full value ring surrounding wind speed values, and overlaps and surrounds said rear face annular arrays of inner, blank cosine cells;

(b) calculating a target range by using said disc on said front face to perform necessary multiplication and division steps.

6. The method of claim 5, further comprising a step calculating wind drift by:

rotating said small disc to align a wind speed value to overlap a blank cosine cell at a correct wind direction; and reading a cosine fraction of the wind speed value on said full value ring in a space radially outward from said wind speed to identify wind drift for said target under existing wind conditions.

7. In the method of claim 6, wherein said flat, rectangular rule member comprises an eyelet at a common center of rotation of all rotatable discs and the scales on both faces that is aligned with the axial center, further comprising placing a weighted string through said eyelet, aligning said string with said rifle or a spotting scope, rotating said member so that said target indicia is lined up with said target, reading elevation angle to target on said angle fire protractor, and using said angle/cosine scale to obtain adjustment for downward or upward elevation to target.

* * * * *